US006192733B1

(12) United States Patent
Long et al.

(10) Patent No.: US 6,192,733 B1
(45) Date of Patent: Feb. 27, 2001

(54) TWO STAGE PRESS

(76) Inventors: Alden Owen Long, 859 Alexander Springs Rd., Carlisle, PA (US) 17013; Michael David Strong, 5013 Lenker St., Mechanicsburg, PA (US) 17055

( * ) Notice: Subject to any disclaimer, the term of this patent is extended or adjusted under 35 U.S.C. 154(b) by 0 days.

(21) Appl. No.: 09/254,753

(22) PCT Filed: Jul. 15, 1997

(86) PCT No.: PCT/US97/12471

§ 371 Date: Mar. 2, 1999

§ 102(e) Date: Mar. 2, 1999

(87) PCT Pub. No.: WO98/02943

PCT Pub. Date: Jan. 22, 1998

Related U.S. Application Data

(60) Provisional application No. 60/021,843, filed on Jul. 16, 1996.

(51) Int. Cl.[7] ..... B21J 15/24; B21J 7/30; H01R 43/04

(52) U.S. Cl. ..... 72/430; 72/707; 29/751; 100/256

(58) Field of Search ..... 72/453.03, 453.04, 72/446, 430, 707, 712; 29/751; 100/256

(56) References Cited

U.S. PATENT DOCUMENTS

| | | | | |
|---|---|---|---|---|
| 3,783,662 | | 1/1974 | Keller et al. | 72/1 |
| 4,646,555 | * | 3/1987 | Postupack | 72/453.03 |
| 4,924,693 | * | 5/1990 | College et al. | 72/453.03 |
| 4,944,669 | | 7/1990 | Zakich | 425/589 |
| 5,277,050 | | 1/1994 | DeRoss et al. | 72/403 |
| 5,517,749 | * | 5/1996 | Zuin | 72/446 |
| 5,813,274 | * | 9/1998 | Strong et al. | 72/430 |
| 5,850,685 | * | 12/1998 | Wright et al. | 29/751 |
| 5,937,510 | * | 8/1999 | Seiersen et al. | 29/753 |
| 5,974,853 | * | 11/1999 | Strong et al. | 72/430 |

FOREIGN PATENT DOCUMENTS

| | | | |
|---|---|---|---|
| 0622873 | 11/1994 | (EP) | H01R/43/048 |

* cited by examiner

*Primary Examiner*—David Jones

(57) ABSTRACT

A press (10) for operating a tooling unit in the performance of a manufacturing operation, such as crimping terminals onto a conductor. The press is adapted for attachment to the frame of a host machine (12), such as a lead maker, and for receiving a tooling unit, such as a terminal applicator (52). The press (10) includes a frame (13), a carriage (20) arranged for reciprocating motion with respect to the frame (13) and a ram (110) in sliding engagement with and carried by the carriage (20). A relatively low powered actuator (22) causes the ram (100) to move through a first incremental amount of movement during the first portion of the crimp cycle and a second, more powerful, actuator (80) causes the carriage (20) and ream (110) assembly to move through a second incremental amount of movement to complete the crimp cycle.

9 Claims, 7 Drawing Sheets

TWO STAGE PRESS

This application is a 371 of PCT/US97/12471, filed Jul. 15, 1997, which claims benefit of Provisional No. 60/021,843, filed Jul. 16, 1997.

FIELD OF THE INVENTION

The present invention relates to a press for operating a tooling unit in the manufacture of articles such as electrical leads, and more particularly to such a press having a ram that moves through a power stroke in two incremental steps.

BACKGROUND OF THE INVENTION

Terminal applicators are commonly used in the electrical connector industry to attach terminals to electrical conductors. These terminal applicators are operated by means of a press that provides the power to actuate the applicator ram and effect the crimping of the terminal onto the conductor. Such presses include a frame, a ram arranged to undergo reciprocating motion toward and away from a platen, and a power source, such as an electric motor. The terminal applicator is secured to the platen and the ram of the applicator is coupled to and carried by the ram of the press. Typically, the electric motor is run continuously to drive a rotating flywheel which is coupled to a single revolution clutch mechanism that drives a crank coupled to the press ram. When the clutch is tripped the press ram is made to reciprocate one cycle. Such a press is disclosed in U.S. Pat. No. 3,343,398. While this press utilizes a moderately sized electric motor for power, it also requires a rather large and massive flywheel, crank, and clutch mechanism. Another approach is a press for a terminal applicator that utilizes an electric motor that is coupled to a ram crank by means of a drive belt. The press includes a control system that energizes the electric motor only when the ram is to be cycled. At other times the motor drive shaft is stationary. This press, of course, requires a rather large and powerful motor and relatively complex motor controller. Such a motor controller is disclosed in U.S. Pat. No. 5,449,990 which issued Sep. 12, 1995 to Bowling et al. Both of these types of presses require that the press crank and ram mechanism be strong and able to accommodate the high forces required to crimp a terminal onto a conductor. As a result, the mechanisms of these presses tend to be bulky and massive, and tend to undergo substantial wear during use. Because of the tendency for these presses to be bulky, the host machines that receive these presses must themselves be larger than would otherwise be necessary.

In U.S. Pat. No. 3,783,662 is disclosed a magnetically actuated die closing apparatus and a control circuit therefor, utilizing reciprocating movement of a ram that is effected by energizing of the coils in a pair of electromagnets and a spring member acting in a reverse direction. The electromagnets thereby form an actuator coupled to the ram for effecting a first and a second incremental amount of movement in a first direction. Stopping of the first movement and initiation of the second movement is determined by a switch assembly mounted on the magnets.

What is needed is a press for operating a tooling unit, such as a terminal applicator, in the manufacture of articles wherein the press utilizes relatively light actuating components that are inexpensive to manufacture. The press should be compact for easy adaptation to host machines of relatively small size.

SUMMARY OF THE INVENTION

A press is provided for operating a tooling unit in the performance of a manufacturing operation. The press includes a frame having a platen attached thereto for receiving the tooling unit. A ram is coupled to the frame and arranged to undergo reciprocating movement in a first direction along a ram axis toward the platen a specific distance in two incremental amounts, and in a second opposite direction along the ram axis, thereby effecting the operation of the tooling unit. A first actuator is coupled to the ram for effecting a first of the two incremental amounts of movement of the ram in the first direction, while a second actuator is coupled to the ram for effecting a second of the two incremental amounts of movement of the ram in the first direction.

BRIEF DESCRIPTION OF THE DRAWINGS

Embodiments of the present invention will now be described with reference to the accompanying drawings, in which.

DETAILED DESCRIPTION

Figure 1:
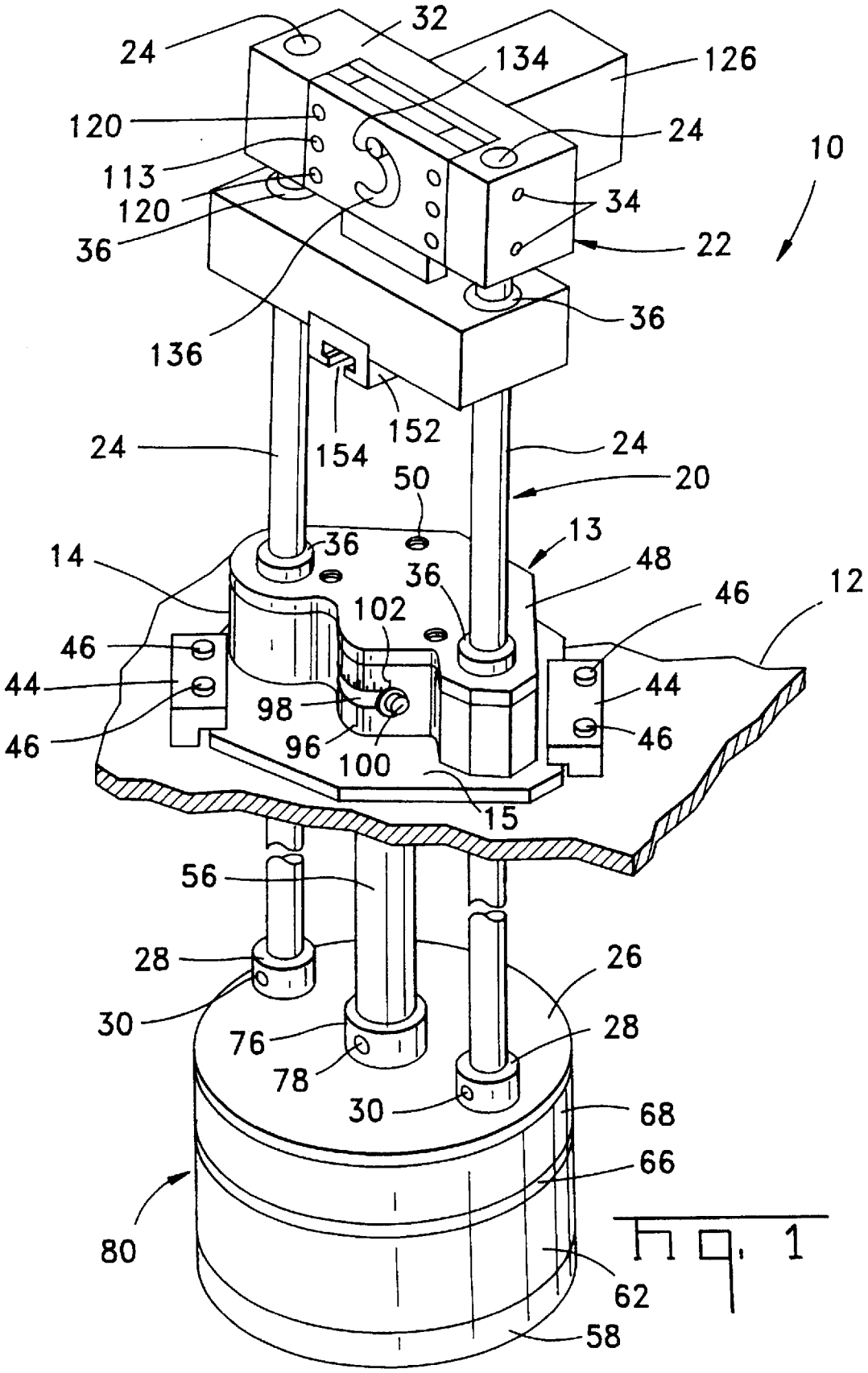
FIG. 1 is an isometric view of a press incorporating the teachings of the present invention.
Figure 3:
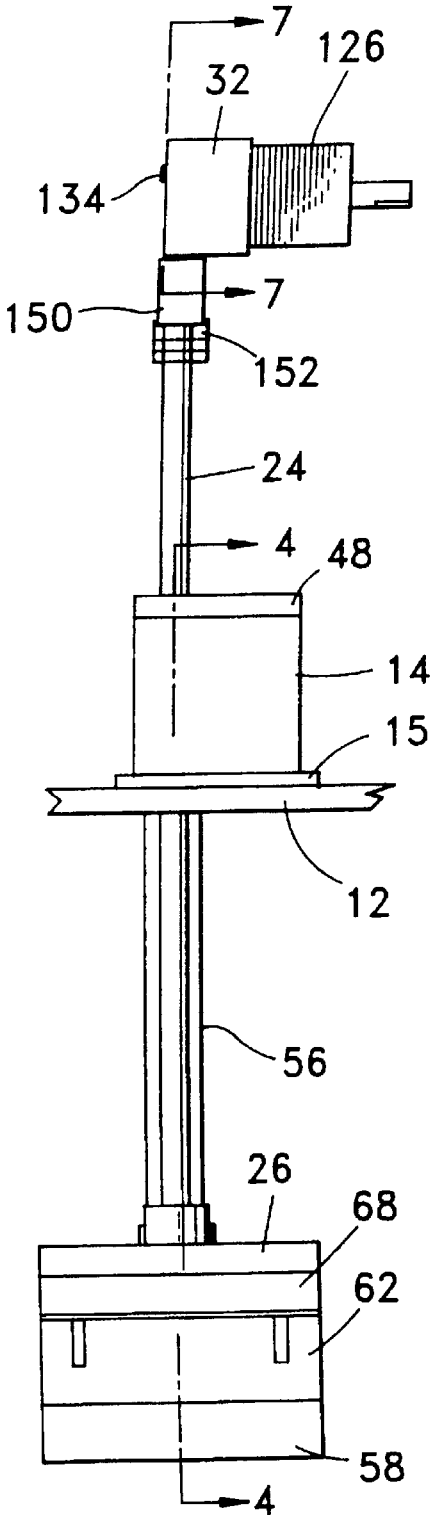
FIGS. 2 and 3 are front and side views, respectively, of the press shown in FIG. 1.

A press 10 is shown in FIG. 1 attached to a host machine 12, the press 10 having a frame 13 consisting of a bolster plate 14 and mounting flanges 15 cast integral thereto, and a carriage 20. Alternatively, the frame may consist of a bolster plate with a mounting plate screwed to its underside to form the mounting flanges. The carriage 20 includes a first actuator 22, two parallel rods 24, and a flange 26. The flange 26 has a pair of spaced bosses 28 having holes through which the lower ends of the rods 24 extend, as viewed in FIG. 1. Two pins 30 extend through holes in the two bosses 28 and the rods 24 to rigidly secure the rods to the flange 26. The opposite ends of the rods 24 extend into blind holes formed in the bottom side of a block 32 and are rigidly secured by means of screws 34 which extend through counterbored holes in the top side of the block and into threaded holes formed in the ends of the rods, as shown in FIG. 1. The two rods 24 extend through bushings 36 that are arranged in the bolster plate 14 to permit reciprocating movement of the carriage 20 with respect to the frame 13 in a direction that is parallel to the longitudinal axes of the rods 24, as indicated by the arrow 38 in FIG. 2. That is, the first actuator 22, the two rods 24, and the flange 26 form a rigid unit that is free to move in the two directions indicated by the arrow 38. Two clamp bars 44 and screws 46 that are threaded into the host machine 12 secure the mounting plate 40 and bolster plate 14 to the host machine. A tooling unit mounting plate 48 is secured to the top of the bolster plate 14 by means of screws 50. The mounting plate 48 includes the usual clamps and locating surfaces, not shown, for accurately positioning and securing the tooling unit, in the present example a terminal applicator 52 shown in phantom lines in FIG. 2.

Figure 4:
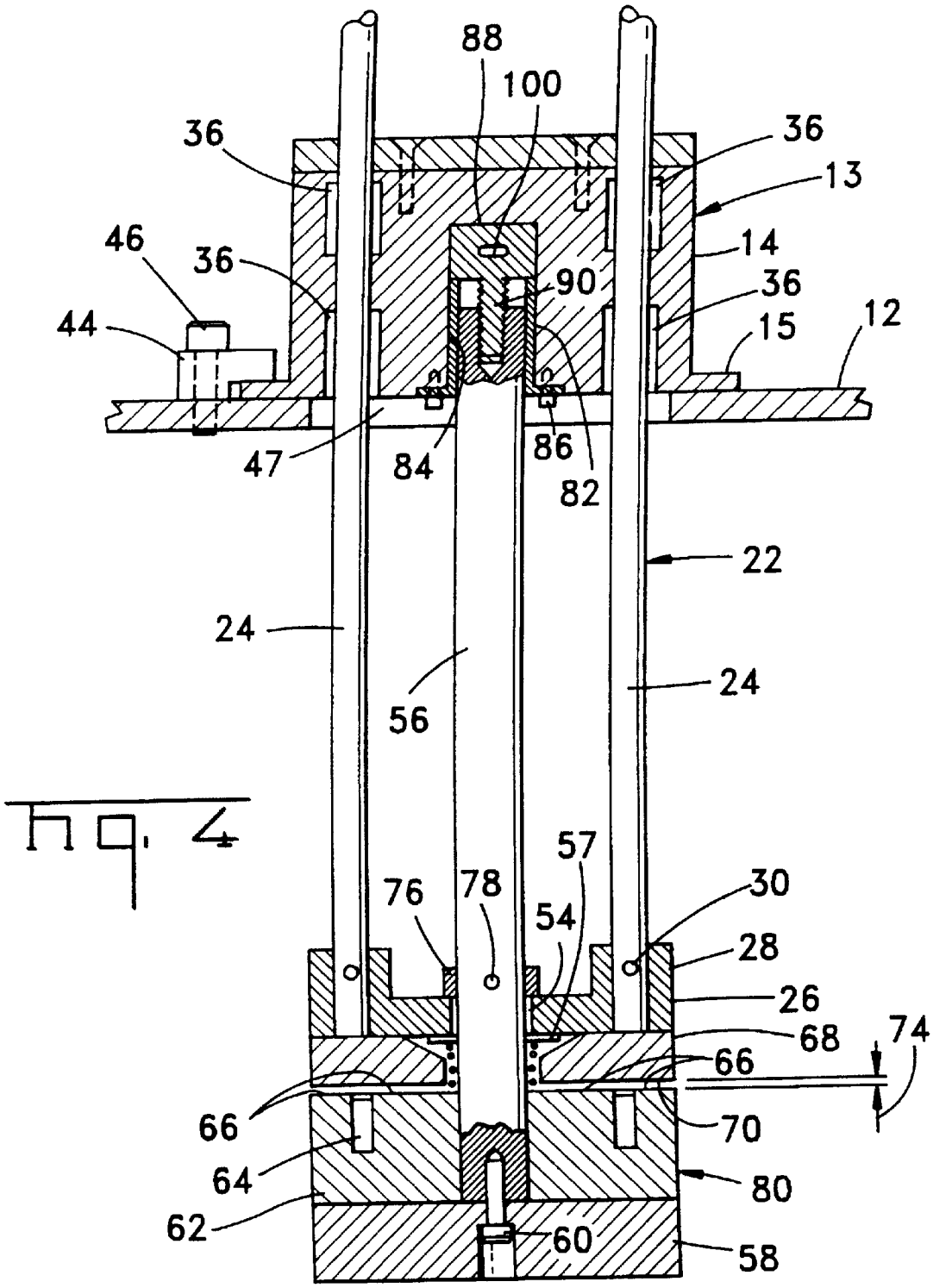
FIG. 4 is a cross-sectional view taken along the lines 4—4 in FIG. 3.

A center post 56 extends downwardly, as viewed in FIG. 4, from the bolster plate 14, through a bearing 54 pressed into a central hole in the flange 26, through a thrust washer 57 and compression spring 72, to a base plate 58. A screw 60 extending upwardly through a counterbored hole in the base plate and into a threaded hole in the end of the center post 56 secures the center post to the base plate. An electromagnet 62 having an electric magnet coil 64 and poll face 66 is attached to the base plate 58 with suitable screws, the poll face 66 opposing the flange 26. A magnet plate 68 having an attraction face 70 is attached to the flange 26 with suitable screws so that the attraction face is directly opposed to the poll face of the electromagnet, as shown in FIG. 4. The electromagnet 62 has a close clearance hole through which the center post 56 extends, while the magnet plate 68 includes a larger central hole through which the center post 56 extends for loosely receiving the compression spring 72. The compression spring 72 pushes against the poll face 66 and the thrust washer 57 to urge the flange 26 and the carriage 22 away from the electromagnet 62 to create the gap 74 between the attraction face 70 and the poll face 66, as shown in FIG. 4. A collar 76 is arranged around the center post 56 and secured in place by means of a pin 78 extending through a hole in the collar and center post. The collar is positioned with respect to the center post to provide a gap 74 of a desired dimension, of about 4.826 (0.190 inch) in the present example. As will be explained below, when the coil 64 of the electromagnet is energized the attraction face 70 is pulled against the poll face 66 thereby closing the gap 74 to zero. The magnet plate 68, electromagnet 62, and associated energizing circuitry are referred to herein as the second actuator 80.

A flanged sleeve 82 is disposed in a counterbored hole 84 formed in the under surface of the bolster plate 14, as best seen in FIG. 4, and is held in place by screws 86 that are threaded into holes in the bolster plate 14. The hole 84 is a blind hole having a square bottom. A jack screw 88 is positioned within the bore 84 between the end of the flanged sleeve 82 and the flat bottom of the bore with clearance so that the jack screw is free to rotate. The jack screw includes a threaded end 90 that is in threaded engagement with a threaded hole 92 formed in the end of the center post 56 opposite the end attached to the base plate. As the jack screw 88 is turned in one direction the center post 56 is forced to move away from the jack screw axially in a direction toward the base plate 58 and when turned in the other direction the center post 56 is forced to move further into the flanged sleeve toward the jack screw. This has the effect of moving the entire carriage 22, magnet plate 68, electromagnet 62, and base plate 58, with respect to the frame 13, without altering the dimension of the gap 74, for a purpose that will be explained. The bolster plate 14 includes a radiused periphery portion 96 that is concentric with the bore 84, as shown in FIG. 1. An elongated slot 98 extends through the radiused portion 96 and into the bore 84. A screw 100 extends through the elongated slot 98 and into a threaded hole formed in the jack screw 88. When it is desired to adjust the axial position of the center post 56, the screw 100 is loosened, the jack screw is rotated by moving the screw 100 within the elongated slot 98 to the desired position indicated by indices 102 formed on the radiused portion 96, and the screw is then tightened against the radiused portion to lock the center post in place.

Figures 5, 7:
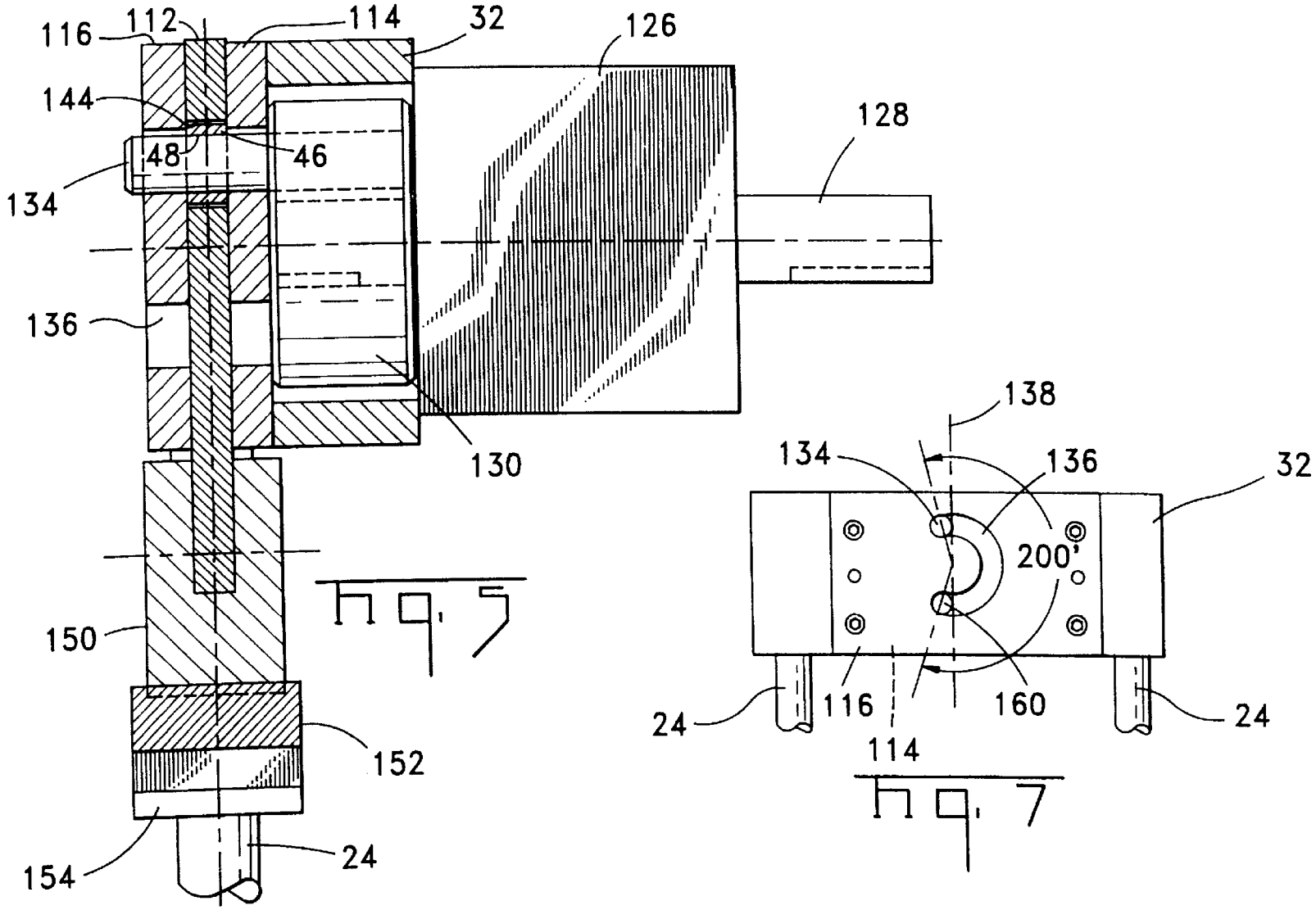
FIG. 5 is a cross-sectional view taken along the lines 5—5 in FIG. 2.
FIG. 7 is a cross-sectional view taken along the lines 7—7 in FIG. 3.
Figure 6:
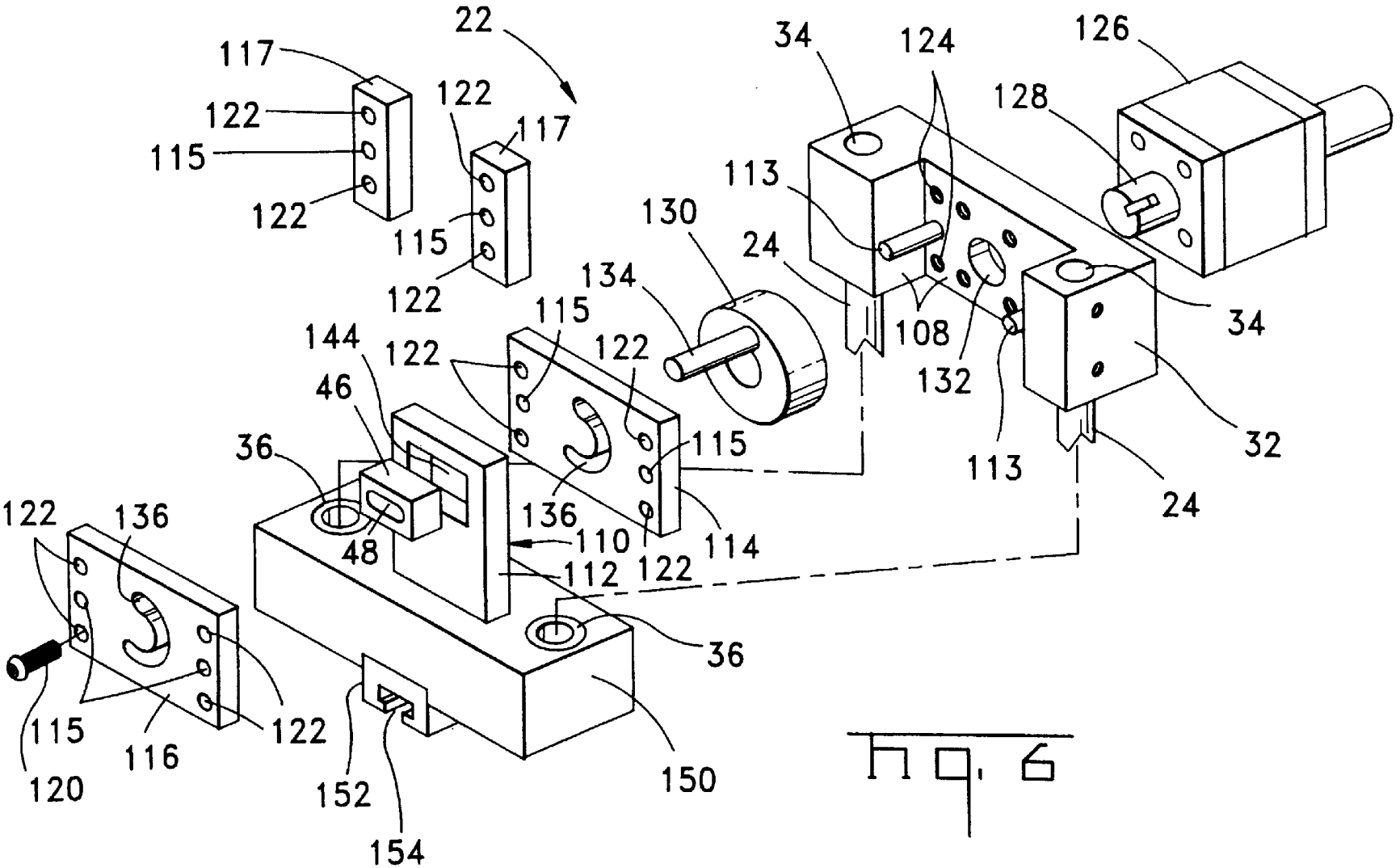
FIG. 6 is an exploded parts view of the actuator shown in FIG. 5.

As shown in FIGS. 5 and 6, the first actuator 22 includes the block 32 which has a cutout 108 formed in one face thereof between the two rods 24. A ram 110 having a ram plate 112 is arranged so that the ram plate and two cam plates 114 and 116, one cam plate on each side of the ram plate, are disposed within the cutout 110. A pair of spacer block 117 are arranged on each side of the ram plate 112 between the two cam plates 114 and 116. Two pins 113, pressed into holes in the block 32, extend through holes 115 formed through the two cam plates and two spacer blocks to position the cam plates within the cutout 108. The assembly is held together by four screws 120 extending through clearance holes 122 in the cover plate and into threaded holes 124 in the block 32. The thicknesses of the ram plate 112 and the two spacer blocks 117 are chosen so that the ram plate is free to slide vertically between the two cam plates 114 and 116, in the directions indicated by the arrow 38 in FIG. 2, without appreciable lateral play. An air powered rotary actuator 126, or other suitable rotary actuator, is attached to the block 32 by means of suitable screws. The actuator 126 has an output shaft 128 that is keyed to a crank 130 having an outside diameter that rotates in a bore 132 formed in the block 32. A crank pin 134 projects from the crank 130 and extends through an arcuate cam track 136, or circular opening, formed in each of the two cam plates 114 and 116. The cam tracks 136 are sized to closely receive the crank pin with little play and are concentric with the bore 132. Each end of the cam tracks 136 terminate on the left side of a vertical centerline 138, as viewed in FIG. 7, and extends through an angle of about 200 degrees, the major portion of the cam track being on the right side of the vertical centerline 138. The vertical centerline 138 intersects the axis of the bore 132 and defines an axis of reciprocating motion of the ram 110 in the directions indicated by the arrow 38 in FIG. 2. The cam tracks 136 are constructed in this way for a purpose that will be explained below. The ram plate 112 includes a rectangularly shaped slot 144 containing a slide block 146. The slide block 146 is retained within the slot between the two cam plates 114 and 116 and is free to slide laterally within the slot with respect to the vertical centerline 138. A hole 148 is formed through the slide block 146, the crank pin 134 extending through the hole. As the rotary actuator 126 rotates the crank 130, the crank pin 134 causes the slide block 146 to slide laterally within the slot 144 and thereby causes the ram plate 112 to move in one of the directions indicated by the arrow 38 in FIG. 2. The ram 110 includes a guide block 150 attached to one end of the ram plate 112. The guide block includes bushings 36 disposed in opposite ends thereof, as best seen in FIG. 6. The rods 24 extend through the two bushings to support and guide the ram 110 during its reciprocating movement in the directions indicated by the arrow 38 in FIG. 2. A coupling 152 is attached to the guide block 150 and includes a T-slot 154 for coupling to the ram of the terminal applicator 52 in the usual manner for operation thereof.

Figure 2:
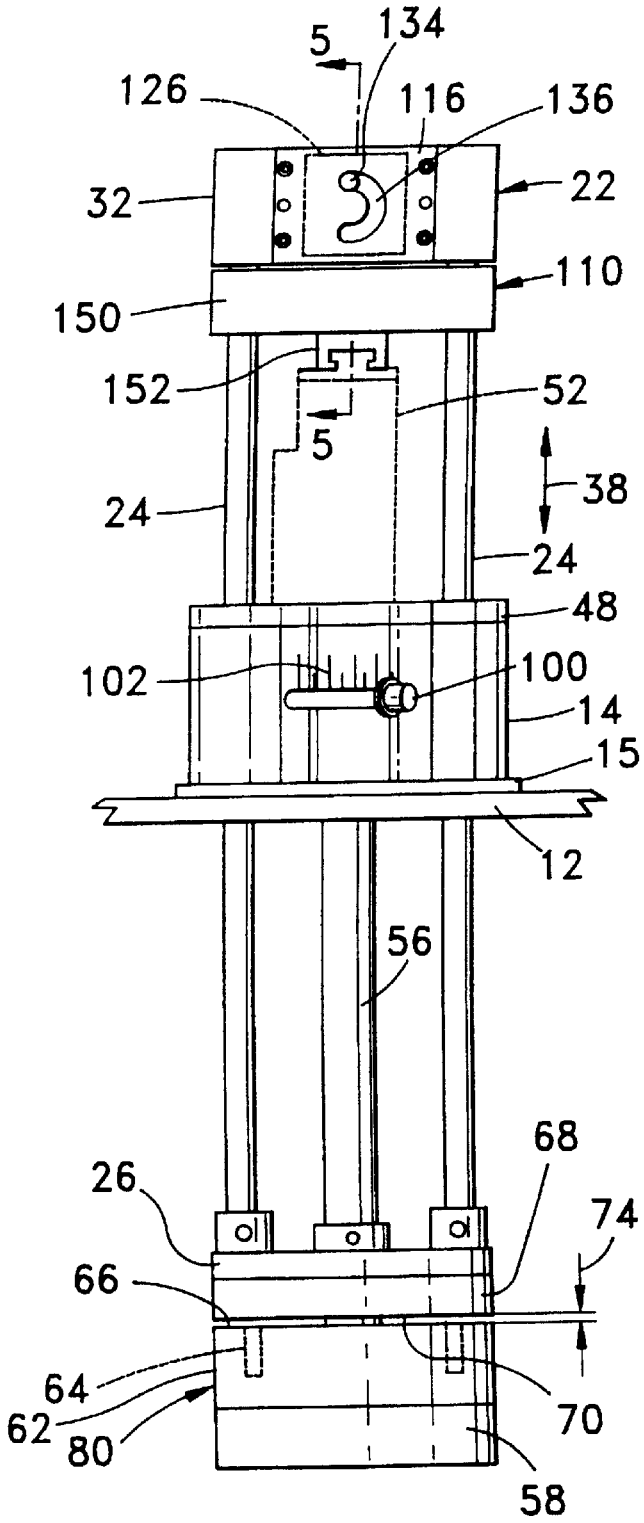
Figure 8:
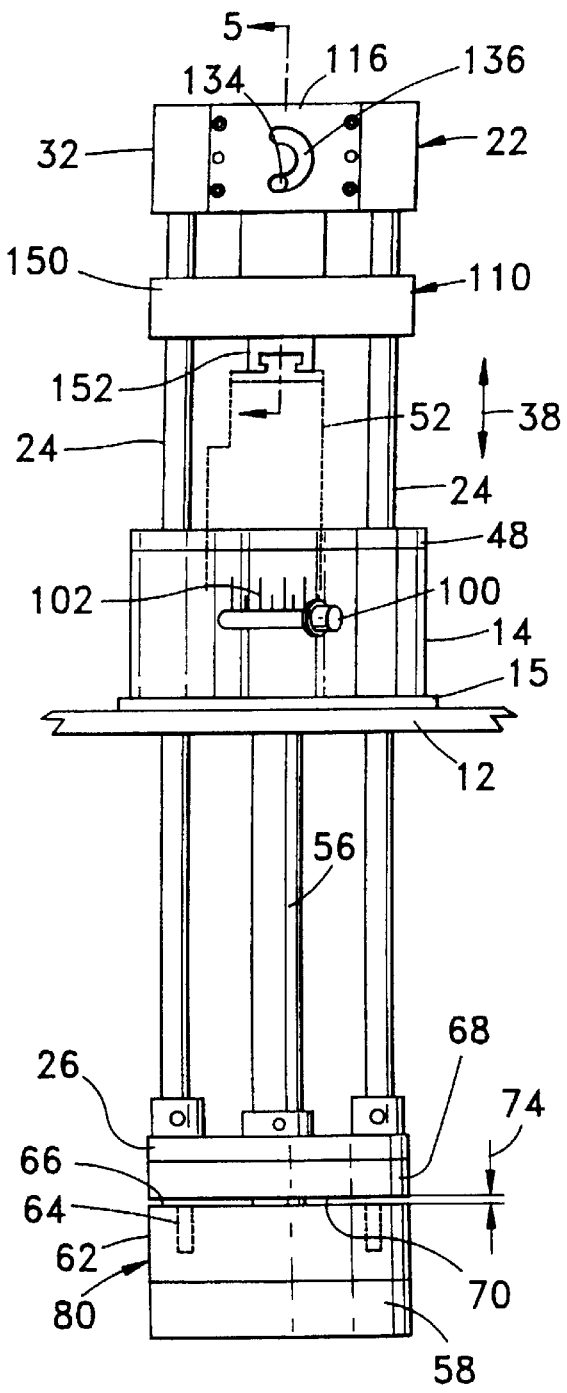
FIGS. 8 and 9 are front views similar to that of FIG. 2 showing the press in various stages of operation.

The operation of the two stage press 10 will now be described with reference to FIGS. 2, and 7 through 11. FIG. 2 depicts the press 10 prior to beginning the crimping operation, with the press ram 110 fully retracted. The attraction surface 70 is spaced from the poll face 66 with a gap distance 74 and the crank pin 134 is in the upper portion of the cam track 136 on the left side of the vertical centerline 138, as shown in solid lines in FIG. 7. Note that this is an over center condition for the crank pin 134 thereby preventing the applicator ram 110 from falling downward toward the bolster plate 14 under the influence of gravity. The actual amount that the crank pin 134 is over center is unimportant, it only being necessary that the axis of the crank pin be to the left side of the vertical centerline 138. That is, a major portion of the crank pin is to the left said of the vertical centerline 138. To begin the operating cycle, the rotary actuator 126 is energized so that the crank 130 is caused to rotate clockwise, as viewed in FIG. 7. As the crank rotates the crank pin 134 tracks within the cam track of both cam plates 114 and 116 causing the slide block 146 to follow within the slot 144, thereby causing the ram plate 112 to move downwardly toward the bolster plate 14. Movement continues until the crank pin 134 has rotated as far clockwise as possible to the position shown in FIG. 8 and the press ram 110 is fully extended as shown. Note that the crank pin 134 is now in the lower portion of the cam track 136 and to the left of the vertical centerline 138, as shown in phantom lines at 160 in FIG. 7. Again the crank pin 134 is in an over center position for a purpose that will be explained. As explained above, the actual amount that the crank pin 134 is over center is unimportant, it only being necessary that a major portion or the axis of the crank pin be to the left side of the vertical centerline 138. The movement of the press ram 110 from the position shown in FIG. 2 to the position shown in FIG. 8 is referred to herein as the first incremental amount of movement and represents about 88 percent of the total movement of the press ram required to operate the terminal applicator 52. In the present example the first incremental amount of movement is about 36.44 mm (1.435 inches). During this movement the applicator ram is caused to move toward a terminal to be crimped onto a conductor, however it does not begin crimping the terminal. Also during this movement the applicator ram, which is coupled to a feed mechanism, causes the feed mechanism to feed a terminal into alignment with the crimp tooling preparatory to performing the crimping operation. Very little power is required to rotate the crank pin 134 because the only functions being performed during this first incremental amount of movement is to operate the terminal feed mechanism.

Figure 9:
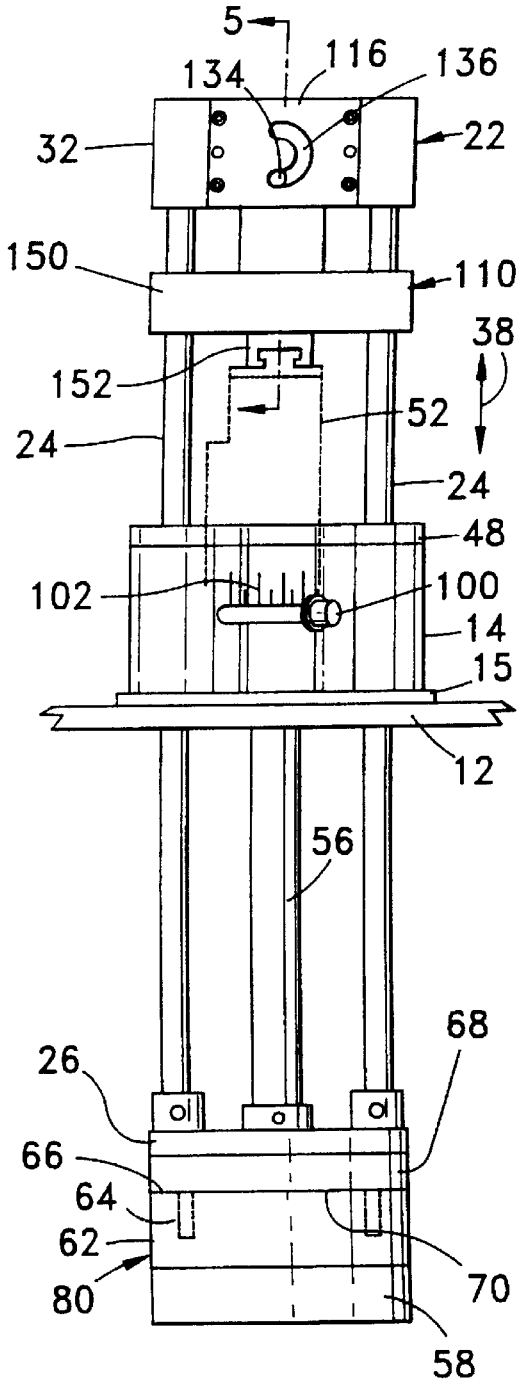
Figure 10:
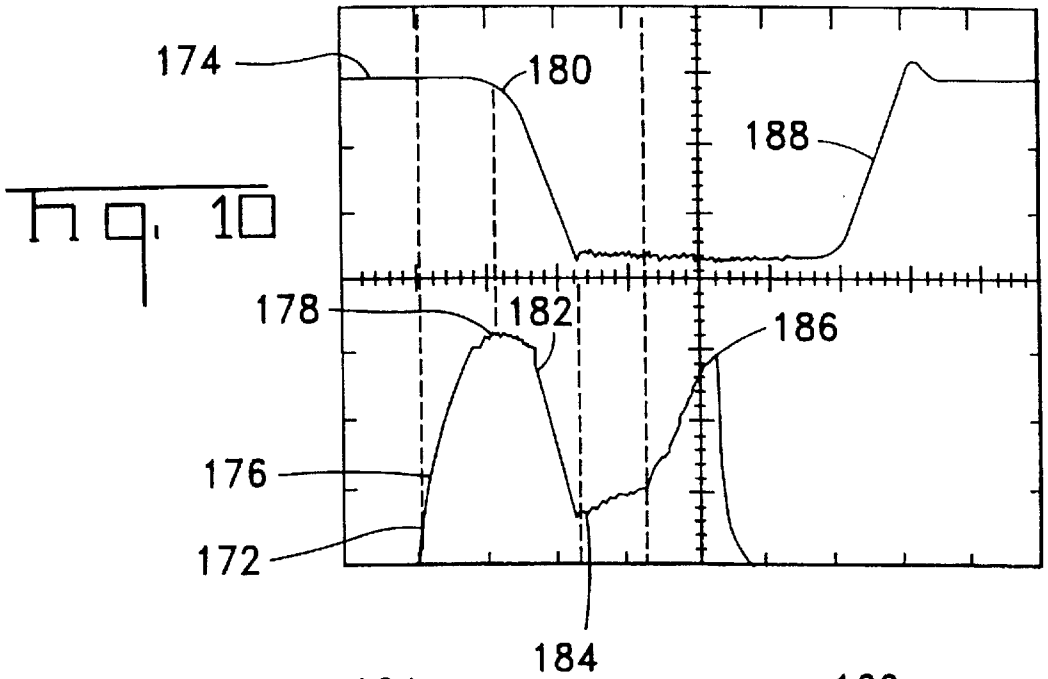
FIG. 10 is a graph illustrating current usage of the electromagnet and ram position with respect to time during the operation of the press.
Figure 11:
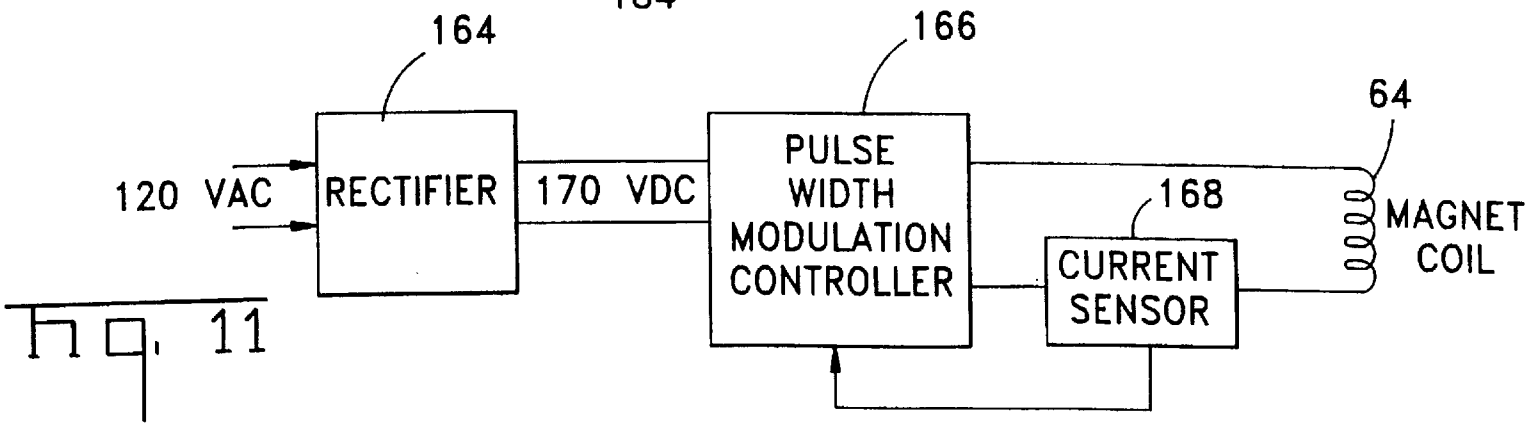
FIG. 11 is a block diagram showing the main functional elements of the magnet coil drive circuit.

At this point of the operating cycle of the press 10, the attraction surface 70 is still spaced from the poll face 66 with a gap distance 74. The magnet coil 64 is then energized by means of a control circuit shown in FIG. 11. The control circuit includes a rectifier 164 interconnected to a pulse width modulation controller 166 and a current sensor 168. A standard power source provides 120 volts AC to the rectifier which rectifies the current and outputs 170 volts DC into the pulse width modulation controller 166. The operation of the control circuit will be best understood with reference to FIG. 10 which shows a current graph 172 and a position graph 174 with their X axes in vertical alignment, the X axes being time. The current graph 172 depicts the amount of current passing through the magnet coil 64 and the position graph 174 depicts the position of the press ram 110 during movement of the attraction face 70 toward the poll face 66. This movement will be referred to herein as the second incremental amount of movement. To begin, the controller 166 outputs a maximum pulse width so that the current available to the magnet coil 64 is a maximum, as shown at 176 in FIG. 10. As the current builds in the magnet coil 64 it reaches a high value at the point 178. At this point in time the carriage 20 and attached magnet plate 68 begin to move downwardly against the upward bias of the spring 72 toward the poll face 66 as indicated at 180 thereby causing the current flow through the magnet coil 64 to peak and begin falling off as indicated at 182. The current sensor 168 senses the current fall off and signals the pulse width modulation controller 166 to reduce the pulse width of the current passing through the magnet coil 64 to a minimum. This minimum current is maintained at a sufficient level to assure continued downward movement of the carriage 20. By minimizing the current flow there is less of a tendency for the magnet plate 68 to violently strike the electromagnet 62. As downward movement of the carriage continues, the tooling on the end of the applicator ram first engages the terminal to be crimped. This results in a resistance to the downward movement of the carriage 20 and causes an increase in the current passing through the magnet coil 64 as indicated at 184 in FIG. 10. The current sensor 168 senses the current increase and signals the pulse width modulation controller 166 to increase the pulse width of the current passing through the magnet coil 64 to a maximum to provide maximum crimping force to the crimping tooling. At this point the gap 74 is reduced to zero and the magnet face 70 is against the poll face 66, as shown in FIG. 9. During this second incremental movement, a force of about 5000 pounds is produced at the crimp tooling. This maximum pulse width current is maintained for a specific time period and at the point indicated at 186 in FIG. 10 is cut off. The compressed spring 72 then causes the carriage 20 to move upwardly away from the electromagnet 62 until the flange 26 engages the collar 76, to the position shown in FIG. 8. This upward movement of the carriage is indicated at 188 in FIG. 10. The rotary actuator 126 is then energized to rotate the crank 130 in a counterclockwise direction so that the crank pin 134 tracks within the cam track of both cam plates 114 and 116 causing the slide block 146 to follow within the slot 144, thereby causing the ram plate 112 to move upwardly away from the bolster plate 14. Movement continues until the crank pin 134 has rotated as far counterclockwise as possible to the position shown in solid lines in FIG. 7 and the press ram 110 is fully retracted as shown in FIG. 2. Note that the crank pin 134 is now in the upper portion of the cam track 136 and to the over center position left of the vertical centerline 138.

As will be appreciated by those skilled in the art, this relatively large crimp force of 5000 pounds generated by the second actuator 80 during the second incremental amount of movement is transferred from the ram of the terminal applicator 52 to the press ram 110, the slide block 146, and the crank pin 134 to the cam plates 114 and 116. Because the crank pin 134 is in an over center position within the cam track 136, all of the forces through the crank pin are in shear. For this reason the first actuator 22 and its component parts can be relatively light in weight and structure. The second actuator 80 is large enough to provide the relatively high crimp force of 1,865 kg (5000 pounds) but need only have a relatively short stroke of about 4.826 mm (0.190 inch). While the first actuator 22 has a relatively long stroke of about 1.435 inches it need only provide a relatively small force to operate the feed mechanism of the terminal applicator.

An advantage of the present invention is that the press produces a relatively high crimp force while utilizing relatively light actuating components that are inexpensive to manufacture. Additionally the press is compact for easy adaptation to host machines of relatively small size.

What is claimed is:

1. A press (10) for operating a tooling unit in the performance of a manufacturing operation, the press being adapted for attachment to a host machine having a frame (12), the press comprising:

a platen (14) attached to said frame for receiving said tooling unit;

a ram (110) coupled to said platen and arranged to undergo reciprocating movement in a first direction along a ram axis (138) toward said platen (14) a specific distance in two incremental amounts, and in a second opposite direction along said ram axis (138), thereby effecting said operation of said tooling unit;

a first actuator (22) coupled to said ram (110) for effecting a first of said two incremental amounts of movement of said ram in said first direction;

a second actuator (80) coupled to said ram (110) for effecting a second of said two incremental amounts of movement of said ram in said first direction; and a carriage (20) slidingly coupled to said platen (14) and arranged to undergo reciprocating motion with respect to said platen in said first and second directions, wherein said ram (110) is coupled to said platen by being slidingly coupled to and carried by said carriage (20) so that said ram (110) can undergo reciprocating motion with respect to said carriage (20) in said first and second directions.

2. The press (10) according to claim 1 characterized in that said first actuator (22) effects said reciprocating motion of said ram (110) with respect to said carriage (20) and said second actuator (80) effects said reciprocating motion of said carriage with respect to said platen (14).

3. The press (10) according to claim 2 characterized in that said ram (110) includes an elongated opening (144) having a major axis extending perpendicular to said first and second directions (38), and said carriage (20) includes a crank (130) arranged to pivot about an axis by means of said first actuator (22) and a crank pin (134) projecting from said crank and extending into said elongated opening (144) so that when said first actuator pivots said crank in one direction said crank pin (134) causes said ram (110) to move in said first direction to an extended position and when said first actuator pivots said crank (130) in an opposite direction said crank pin (134) causes said ram (110) to move in said second direction to a retracted position.

4. The press (10) according to claim 3 characterized in that said pivot axis of said crank (130) is perpendicular to said first and second directions (38) and said carriage (20) includes two mutually aligned circular openings (136) on opposite sides of said ram (110), wherein said crank pin (134) extends through both said circular openings (136) and is arranged to transfer forces acting on said ram (110) in said first and second direction (38) to said carriage (20).

5. The press (10) according to claim 4 characterized in that each of said circular openings (136) has a center of revolution that intersects said ram axis (138), each circular opening having two opposite ends on a first side of said ram axis and extending through 180 degrees of revolution on the side of said ram axis (138) opposite said first side.

6. The press (10) according to claim 5 characterized in that said two circular openings (136) are arranged so that when said ram (110) is in both said extended position and retracted position a major portion of said crank pin (134) is on said first side of said ram axis (138).

7. A press (10) for operating a tooling unit in the performance of a manufacturing operation, the press being adapted for attachment to a host machine having a frame (12), the press comprising:

a platen (14) attached to said frame for receiving said tooling unit;

a ram (110) coupled to said platen and arranged to undergo reciprocating movement in a first direction along a ram axis (138) toward said platen (14) a specific distance in two incremental amounts, and in a second opposite direction along said ram axis (138), thereby effecting said operation of said tooling unit;

a first actuator (22) coupled to said ram (110) for effecting a first of said two incremental amounts of movement of said ram in said first direction; and a second actuator (80) coupled to said ram (110) for effecting a second of said two incremental amounts of movement of said ram in said first direction, wherein said second actuator (80) is an electromagnet (62) having a coil (64) that is energized by a first level of current (176) for a first portion of its movement, a second level of current (182) for a second portion of its movement, and a third level of current (186) for a third portion of its movement.

8. The press (10) according to claim 7 characterized in that said second level of current (182) is less that said third level of current (186).

9. The press (10) according to claim 8 characterized in that said second level of current (182) is arranged to begin when said tooling unit engages said workpiece.

* * * * *